United States Patent [19]

Hall et al.

[11] 4,350,845

[45] Sep. 21, 1982

[54] REVERBERATION APPARATUS

[75] Inventors: William H. Hall, Dallas; John R. Saul, Arlington, both of Tex.

[73] Assignee: Micmix Audio Products, Inc., Dallas, Tex.

[21] Appl. No.: 83,360

[22] Filed: Oct. 10, 1979

[51] Int. Cl.[3] ..... G10H 1/04

[52] U.S. Cl. ..... 179/1 J

[58] Field of Search ..... 179/1 J; 84/DIG. 26, 84/1.25

[56] References Cited

U.S. PATENT DOCUMENTS 3,106,610 10/1963 Young ..... 179/1 J 3,159,713 12/1964 Laube ..... 179/1 J

*Primary Examiner*—Joseph A. Popek

*Attorney, Agent, or Firm*—Kanz & Timmons

[57] ABSTRACT

An apparatus having a plurality of time delays for providing simulated reverberation of an electrical signal representative of sound is disclosed. The time delays are chosen so that delay times of initially delayed signals and reflected signals are logarithmically evenly spaced. One arrangement is adapted for driving a plurality of amplifiers of a multiple channel amplifier system by dividing the time delays into a plurality of groups responding to the plurality of amplifiers, and then connecting the groups of time delays to the amplifiers. A different group of time delays can drive each amplifier.

18 Claims, 8 Drawing Figures

REVERBERATION APPARATUS

TECHNICAL FIELD

The present invention relates generally to artificial reverberation apparatus, and in one of its aspects, to a method for making an apparatus for providing reverberation of an electrical signal representative of sound.

It has long been known that a live performance of music in a large auditorium or other concert hall provides a pleasing sound not achieved by normal studio recordings. In a live performance in a concert hall, a listener in the audience will hear the sounds directly from the performers followed shortly by the sounds of the performers as reverberated from the wall in the front of the auditorium behind the performers and the sounds of the performers as reverberated off the wall behind the audience in the back of the auditorium as well as sounds from the performers as reverberated off other walls, the top of the auditorium and other objects. The sequence and timing in which a listener hears the various reverberated sounds depends upon the position of the listener in the auditorium. The echo density, on the other hand, will generally depend more upon the size of the auditorium. For most listeners, the first fifty milliseconds is the most critical for reverberation sounds.

Most listeners prefer a certain relationship between audible frequencies. Frequencies produced by a piano, for example, are essentially related by the twelfth root of two, a relationship known as the equally tempered chromatic scale. An octave is the interval between two sounds having a frequency ratio of two. An interval in octaves between any two frequencies is the logarithm to the base two of the frequency ratio.

BACKGROUND ART

Many attempts have been made to electrically simulate the acoustic environment of large halls and auditoriums. It is common for such devices to utilize a plurality of means for delaying the original electrical signal, each delay means delaying the original electrical signal a different amount of time. In order to increase the echo density of the reverberated signal using the minimum number of delay means, such apparatus frequently utilize means for reentering the delayed signals into the time delay means. The reentered signals, referred to as "reflections", are reentered at different points in the delay means so that the additional delay time between the originally delayed signal and the first reflection will vary from significantly less than the original delay time to as much as twice the original delay time.

Typical of such reverberation apparatus are apparatus which use helical spring delay means. Several such springs are connected at one end to a source of electrical signals which vibrate the springs. The opposite ends of the springs are connected to some means for converting from the mechanical vibrations back to the corresponding electrical signals at an output terminal or terminals. The delayed signals are then recombined with the original source signals at some point prior to converting the electrical signals into the sounds which they represent. The springs are of different total delay times. Additionally, because of the mechanical reflections at the output of each spring, the springs are equipped with a natural form for reentering the signal into the delay means. The spring vibration which is partially reflected off the output end of the spring will then travel down the spring to be partially reflected off the input end of the spring. As a result, a reflection will be received at the output end of each spring after three times the spring delay time of the original signal which caused the reflection. This represents an additional delay of the signal of twice the delay time of the spring following the receipt at the output of the original delayed signal. Additional reflections can be obtained from discontinuities in the spring such as shown in numerous patents which will be referred to.

Reverberation apparatus are also known which use electronic time delay means. Typical of such time delay means is the common charge coupled or "bucket brigade" type. The output signal can then be fed back into the bucket brigade at any point to create a reflection. If fed back at the beginning of the time delay means, then the additional time between the original delay signal and the reflection is equal to the original delay time. The total delay from the time the original signal is received by the delay means to the receipt of the reflection at the output is twice the delay time for the original delayed output. A second reflection will then be received at three times the original delay time, and so on.

Time delay means have also been constructed which make use of tapped output signals. In such a system, the delay time from the input to the first tap operates as a first time delay means, the delay time from the input to the second tap operates as a second time delay means, and so forth.

The methods for making the apparatus having the time delay means have varied considerably. The time delay means have been chosen so that the intervals between the natural frequencies of the device are constant as shown in U.S. Pat. No. 2,923,369 (Kuhl). Others have merely used appreciably different spring lengths as mentioned in U.S. Pat. No. 2,982,819 (Meinema) without regard to the actual differences between the delay times. Some delay times have simply been found to be satisfactory. For instance, a two spring systems with delay times of 37 milliseconds in one spring and 29 milliseconds in the other are mentioned as satisfactory in U.S. Pat. No. 3,106,610 (Young) and in U.S. Pat. No. 3,159,713 (Laube).

In other systems, spring lengths have been chosen to be resonant at certain frequencies. U.S. Pat. No. 3,281,724 (Schafft) chose the use of springs which are resonant at very low frequencies for efficient energy transfer at all of the harmonics of the resonant frequencies. Two springs of identical characteristics are used, one spring being fixed at both ends to be resonant at one-half wave length and the other spring being fixed at one end and freely suspended at the other to be one-quarter wave length resonant. U.S. Pat. No. 3,431,516 (Schafft) shows the use of coupling links between the two springs at unspecified locations. U.S. Pat. No. 3,391,250 (Klaiber) shows the use of a single spring device with damping in an attempt to overcome the reinforcement and damping problems encountered with helical springs having different natural periods of vibration.

U.S. Pat. No. 3,363,202 (Meinema) and U.S. Pat. No. 3,347,337 (Mochida et al.) show multiple spring devices which use springs of unspecified different lengths and characteristics. U.S. Pat. No. 3,564,106 (Pavia) mentions only that the two springs should have slightly different transmission characteristics, whereas U.S. Pat. No. 3,402,371 (Weingartner) which uses coil springs having different diameters arranged concentrically mentions only that the ratio of delay times associated with the springs is preferably an irrational number.

DISCLOSURE OF INVENTION

In accordance with the present invention, a method for making an apparatus having N time delay means for providing simulated reverberation of an electrical signal representative of sound, includes the combination of choosing a maximum delay means having a time delay of $T_N$, choosing a minimum time delay means having a time delay of $T_1$, and choosing N−2 time delay means, each having a time delay intermediate between $T_1$ and $T_N$ wherein the difference between the logarithms of the time delays of temporally adjacent time delay means are substantially equal. In such an arrangement, N is at least three, but in an alternative arrangement N can be as few as two. In such an arrangement, the method includes the steps of choosing a maximum time delay means, and choosing a minimum time delay means. At least one of the time delay means is chosen from the type having reflections. The delay times of the time delay means are adjusted so that the differences between the logarithms of the time delays to temporally adjacent output signals, including original output signals and reflected output signals, are substantially equal. In every case, there can be additional output signals, reflected which are not logarithmically evenly spaced as long as the logarithmically evenly spaced signals are present.

In one arrangement, choosing a minimum time delay means includes the steps of choosing a time delay means from the type having reflections with a total delay time to a reflection within the time delay means of M times the delay time to the original output signal, where M is a positive number greater than one. The delay time $T_1$ is adjusted so that the difference between the logarithm of M times $T_1$ and the logarithm of $T_N$ substantially equals the difference between the logarithm of the time delays of temporally adjacent time delay means.

In a preferred method, the steps of choosing the time delay means includes the steps of choosing time delay means from the type having reflections and in which the delay time to a reflection from an output signal can be chosen independently of the original delay time, and adjusting the time delay means to where the logarithms of the total delay times to reflections from an input signal causing the reflections are substantially equally spaced.

A method according to the present invention for an apparatus for driving a plurality of amplifiers of a multiple channel amplifier system includes dividing the time delay means into a plurality of groups corresponding to the plurality of amplifiers, and connecting the groups of time delay means to the amplifiers with a different group of time delay means driving each amplifier. Some time delay means may be common to more than one group, depending on the arrangement.

These and other objects, advantages and features of this invention will be apparent from the following description taken with reference to the accompanying drawings, wherein is shown the preferred embodiments of the invention.

BEST MODE FOR CARRYING OUT THE INVENTION

Figure 1:
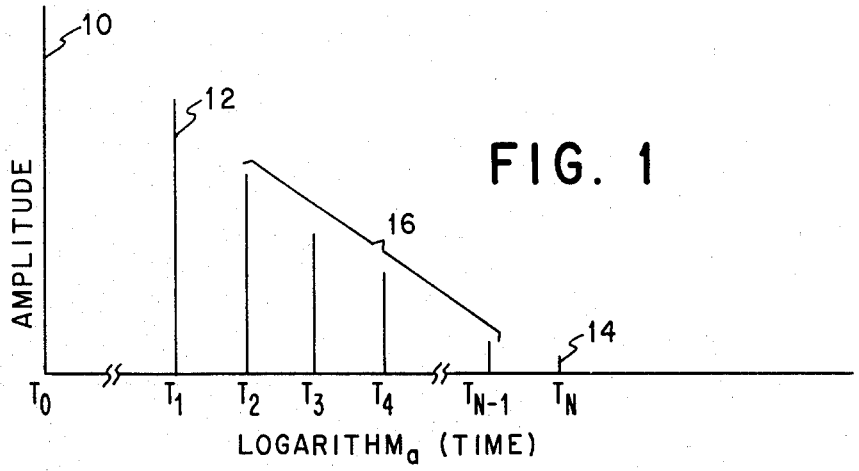
FIG. 1 is a chart representing the amplitude versus the logarithm of the delay times for output signals of an apparatus made in accordance with the present invention.

Referring now to the drawings, and in particular to FIG. 1, a method according to the present invention for making an apparatus having N time delay means for providing simulated reverberation of an electrical signal representative of sound includes choosing a maximum time delay means having a time delay of $T_N$, and choosing a minimum time delay means having a time delay of $T_1$. For a signal 10 which occurs at $T_0$ generally decreasing signals occur at the outputs of the various time delay means beginning with the output signal 12 of minimum time delay means at $T_1$ to the output signal 14 of the maximum time delay means occurring at $T_N$. According to the present invention, N−2 time delay means represented by outputs 16 are chosen, each having a time delay intermediate between $T_1$ and $T_N$. The differences between the logarithms of the time delays of temporally adjacent time delay means are substantially equal. The time for a full cycle of a particular frequency is the inverse of that frequency. An interval in octaves between any two frequencies is the logarithm to the base 2 of the frequency ratio. It is believed that just as the human listener seems to have a preference for frequencies that are logarithmically equally spaced, that the human listener also has preference for the spacing between delay times between reverberations that are logarithmically equally spaced. Other outputs may also occur, but the outputs that are substantially logarithmically equally spaced need to occur.

Figure 2:
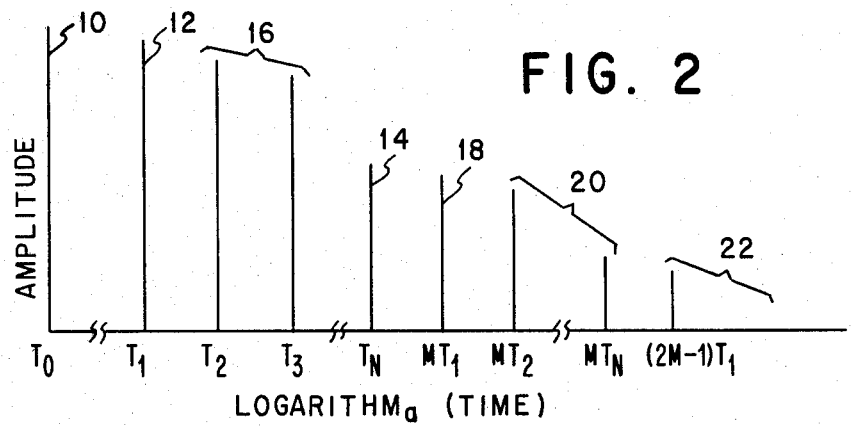
FIG. 2 is a chart similar to that of FIG. 1 for an apparatus made according to the present invention using time delay means of a type having reflections.

Referring now to FIG. 2, a method according to the present invention for choosing a minimum time delay means includes the steps of choosing a time delay means from the type having reflections with a total delay time to a reflection within the time delay means of M times the delay time to the original output signal, where M is a positive number greater than one, and then adjusting the delay time $T_1$ to substantially equal:

$$(1/M)\ \text{antilogarithm}_a\ (1/N\ \text{logarithm}_a\ M + \text{logarithm}_a\ T_N). \qquad \#1$$

The base "a" is arbitrary. Thus a reflection output 18 occurs at $MT_1$ and the differences between the logarithms of the time delays to temporally adjacent output signals are substantially equal. This means that logarithm $MT_1$ minus logarithm $T_N$ substantially equals logarithm $T_X$ minus logarithm $T_{X-1}$. The step of choosing the N−2 time delay means includes the steps of choosing the N−2 time delay means from the type having reflections with total delay times to reflections within the time delay means of M times the delay time $T_X$, where X is a positive integer between 2 and N−1 inclusive, and then adjusting the delay time $T_X$ for each time delay means to substantially equal:

$$\text{antilogarithm}_a\ (\text{logarithm}_a\ T_1 + ((X-1)/N)\ \text{logarithm}_a\ M). \qquad \#2$$

Thus, if the maximum time delay means is chosen with similar characteristics, outputs 20 occur at $MT_2$ through $MT_N$, and since those output signals will in turn be reflected again, further output signals 22 will occur at $2(M-1)T_1+T_1$ which equals $(2M-1)T_1$, and so forth.

Figure 3:
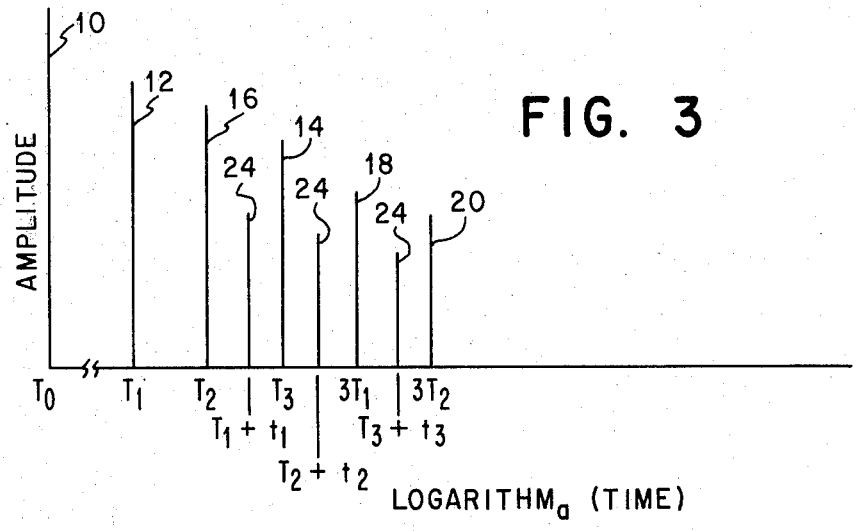
FIG. 3 is a chart similar to that of FIG. 1 for an apparatus made in accordance with the present invention, having time delay means of the type in which the delay time to at least one reflection from an output signal can be chosen independently of the original delay time.

Referring to FIG. 3, one method according to the present invention of choosing the time delay means includes the steps of choosing time delay means from the type having reflections and in which the delay time to at least one reflection from a output signal can be chosen independently of the original delay time, and then adjusting the time delay means to where the logarithms of the total delay times to reflections from an input signal causing the reflections are substantially equally spaced. For example, using a system made up of spring delay times with discontinuities in the springs that cause additional reflections, the total delay time to the reflection from the beginning of the spring from the original signal at $T_0$ is three times the original delay time. Thus for a three-spring system, reflections will occur at $3T_1$, $3T_2$, and $3T_3$. By properly choosing the position of the discontinuities, the logarithms of the total delay times to reflections 24 from an input signal at $T_0$ causing the reflections are substantially equally spaced. In fact, the values are chosen so that the logarithms of the times to reflections 24 are equally spaced from the logarithms of the times for the adjacent originally delayed signals or primary reflected signals are substantially equal. The secondary reflections 24 serve to fill in the gaps between the original delayed signals and the primary reflections to make a smoother sound. The total delayed time to a reflection $t_x$ substantially equals:

$$\text{antilogarithm}_a\ (\text{logarithm}_a\ t_1 + ((X-1)/N)\ \text{logarithm}_a\ 3). \qquad \#3$$

Figure 4:
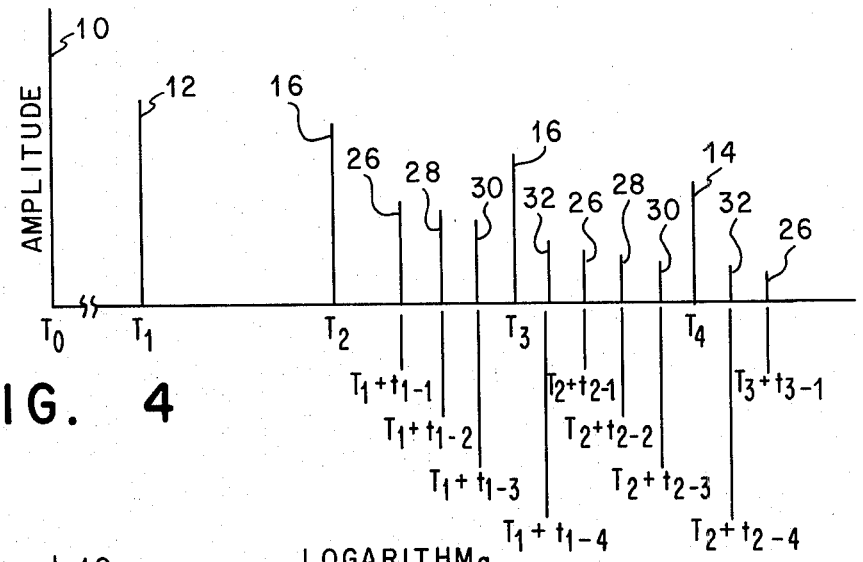
FIG. 4 is a chart similar to that of FIG. 3 for time delay means of a type in which the delay times to at least four reflections from an output signal can be chosen independently of the original delay time.

The time between the temporally adjacent outputs at $T_X$ and $t_1$ substantially equals antilogarithm$_a$ $(1/(N+n))$ logarithm$_a$ 3. Referring to FIG. 4, the same idea can be repeated with numerous secondary reflection points created by numerous corresponding discontinuities in the springs. Reflections 26 at $T_1+t_{1-1}$, $T_2+t_{2-1}$, $T_3+t_{3-1}$, and so on are created from the spring discontinuities closest to the output ends of the springs. The discontinuities which are the next closest create reflections 28 at $T_1+t_{1-2}$, $T_2+t_{2-2}$, and so forth. Similarly, the next set of discontinuities create the reflections 30, and the set of discontinuities closest to the input ends of the springs are responsible for reflections 32. A larger logarithmic spacing is left between reflections 30 and reflections 32 than between other sets of reflections since the original delayed outputs fall in that gap. The result is that all of the output signals, whether originally delayed signals or reflections, are evenly logarithmically spaced.

In general, in making an apparatus having spring or similar type delay means, the time delay $T_1$ is adjusted to substantially equal:

$$(\tfrac{1}{3})\ \text{antilogarithm}_a\ ((1/N)\ \text{logarithm}_a\ 3 + \text{logarithm}_a\ T_N), \qquad \#4$$

and the time delay $T_X$ for the N−2 time delay means substantially equals:

$$\text{antilogarithm}_a\ (\text{logarithm}_a\ T_1 + ((X-1)/N)\ \text{Logarithm}\ 3). \qquad \#5$$

Figure 5:
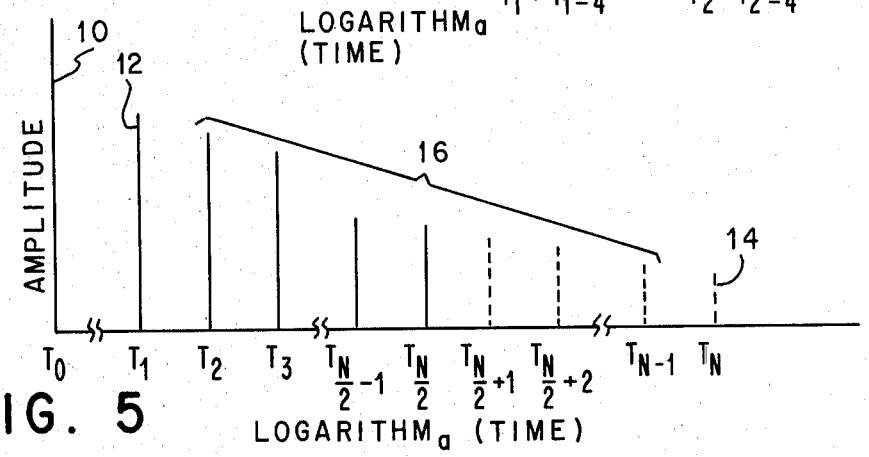
FIG. 5 is a chart similar to that of FIG. 1 wherein the time delay means are divided into a plurality of groups for driving a plurality of amplifiers of a multiple channel amplifier system.
Figure 6:
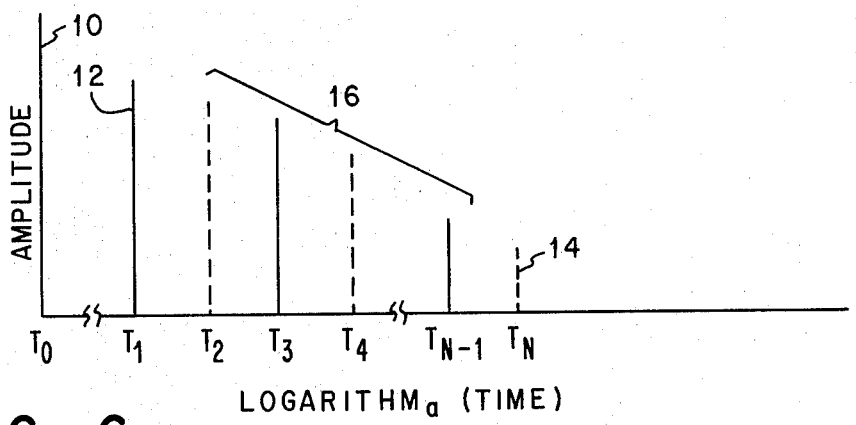
FIG. 6 is a chart similar to that of FIG. 5 in which the groups are chosen in a different manner.

Referring now to FIGS. 5 and 6, a method according to the present invention for making an apparatus for driving a plurality of amplifiers of a multiple channel amplifier system such as a stereo system or a quadriphonic system includes the steps of dividing the time delay means into a plurality of groups corresponding to the plurality of amplifiers, and connecting the groups of time delay means to the amplifiers. A different group of time delay means drives each amplifier. For example, referring in particular to FIG. 5, the time delay means corresponding to time delays $T_1$ through $T_{N/2}$ are connected into one group for driving one channel of a stereo system while the delay means corresponding to time delays of $T_{N/2+1}$ through $T_N$ are connected in a group for the other channel. Such an arrangement can be used to give stereo enhancement to a monaural recording as well as providing reverberation effects for a stereo recording. An alternative grouping, referring to FIG. 6, is to combine all odd numbered delay means in one group and all even numbered delay means in the group for the opposite channel.

Figure 7:
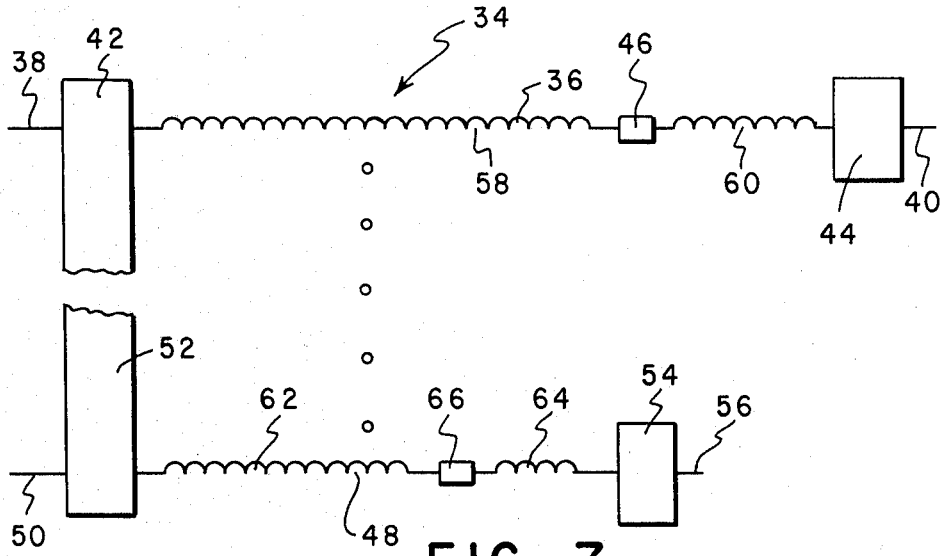
FIG. 7 is a pictorial representation of an apparatus made according to the present invention, using spring time delay means.

Referring now to FIG. 7, an apparatus made in accordance with the present invention using springs for time delay means is referred to generally by reference numeral 34. Spring 36 corresponds to time delay means for $T_N$ from electrical input 38 to electrical output 40. Transducer 42 converts the electrical energy received at input 38 into mechanical energy applied to spring 36, and output transducer 44 reconverts the mechanical energy from spring 36 to electrical energy at electrical output 40. Some of the mechanical energy is reflected from transducer 44 back toward input transducer 42, and some of that energy is in turn reflected off discontinuity 46 to be once again transmitted toward output transducer 44. Spring 48 corresponding to the minimum time delay $T_1$ along with its electrical input 50, input transducer 52, output transducer 54 and electrical output 56 operates in a similar manner. Spring 36 really consists of two springs, input spring 58 and output spring 60 which are joined together by coupler 46 which forms the discontinuity for reflections. Similarly spring 48 consists of input spring 62 and output spring 64 joined together by coupler 66. Normally, the input spring and the output spring will be wound oppositely. A typical method for adjusting spring delay means according to the present invention is to first determine the desired overall delay time, then determine the desired delay time for the reflections from the discontinuity. In this case $t_n$, the time from the first output at transducer 44 to the first reflection output at transducer 44, will be twice the delay time of output spring 60 so output spring 60 will be cut first. Input spring 58 is then cut to a length to achieve the desired overall delay time $T_N$.

Figure 8:
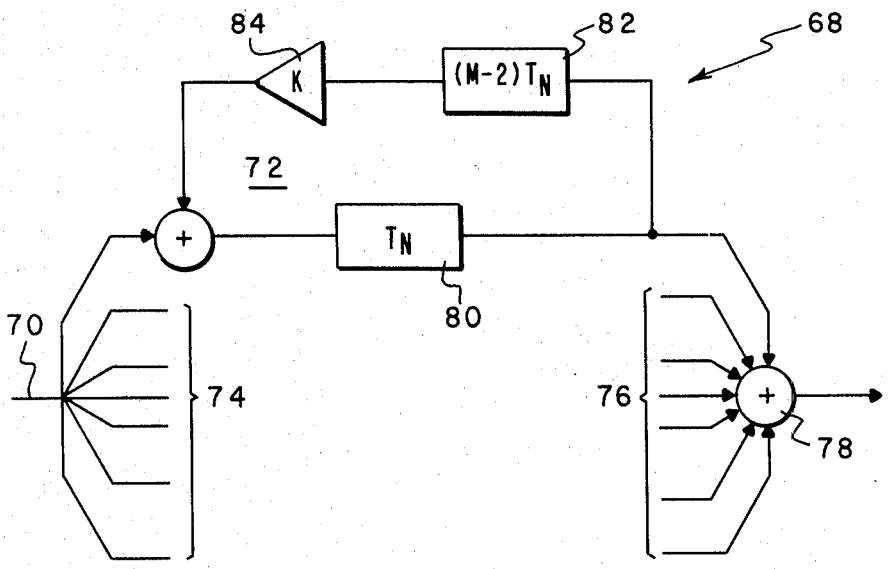
FIG. 8 is a diagramatic representation of an apparatus made in accordance with the present invention, using electronic time delay means.

Referring now to FIG. 8, an apparatus made in accordance with the present invention and utilizing electronic time delay means is referred to generally by reference numeral 68. The original signal is received at electrical input 70 and is transmitted to time delay means 72 which corresponds to time delay $T_N$ as well as to the remaining time delay means through inputs 74. The output of time delay means 72 is summed with the outputs 76 of the other time delay means at output 78. Time delay means 72 has an overall initial time delay 80 of $T_N$ and a feedback delay 82 of $(M-2)T_N$ and a loop gain 84 of K. Where the output of initial time delay 80 is simply fed back to the input, M=2. Choosing a minimum time delay means includes adjusting the delay time $T_1$ to substantially equal:

$$(\tfrac{1}{2})\ \text{antilogarithm}_a\ ((1/N)\ \text{logarithm}_a\ 2+\text{logarithm}_a\ T_N), \qquad \#6$$

and choosing the N−2 time delay means includes adjusting the delay time for each time delay means to substantially equal:

$$\text{antilogarithm}_a\ (\text{logarithm}_a\ T_1+((X-1)/N)\ \text{logarithm}_a\ 2). \qquad \#7$$

EXAMPLE

Referring again to FIG. 7, it is desired to make an apparatus having 12 time delay means for providing simulated reverberation of an electrical signal representative of sound for use with a stereo system. It is decided to use the odd numbered time delays for the left speaker and the even numbered time delays for the right speaker. The longest time delay for a spring readily available is 37 milliseconds, so a 37 millisecond spring is used for $T_{12}$. Using natural logarithms which are logarithms to the base e and formula 4:

$$T_1=(\tfrac{1}{3})\ \text{antiln}\ ((1/12)\ \ln 3+\ln 37.)=13.5\ \text{milliseconds} \qquad \#8$$

$T_2$ is computed using formula 5:

$$T_2=\text{antiln}\ (\ln 13.5+((2-1)/12)\ \ln 3)=14.8\ \text{milliseconds} \qquad \#9$$

In a similar manner, all of the values can be chosen. The results (in milliseconds) are as follows and may be rounded in practice to a lesser decimal:

| Left Channel | Right Channel |
|---|---|
| $T_1$ = 13.5 | $T_2$ = 14.8 |
| $T_3$ = 16.2 | $T_4$ = 17.8 |
| $T_5$ = 19.5 | $T_6$ = 21.3 |
| $T_7$ = 23.4 | $T_8$ = 25.6 |
| $T_9$ = 28.1 | $T_{10}$ = 30.8 |
| $T_{11}$ = 33.7 | $T_{12}$ = 37.0 |

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

We claim:

1. An apparatus having N time delay means, N being at least three, for providing simulated reverberation of an electrical signal representative of sound, comprising in combination:

maximum time delay means for delaying the electrical signal a time delay of $T_N$;

minimum time delay means functionally in parallel with the maximum time delay means for delaying the electrical signal a time delay of $T_1$; and N−2 time delay means functionally in parallel with the maximum time delay means for delaying the electrical signal, each having a time delay intermediate between $T_1$ and $T_N$ wherein the differences between the logarithms of the time delays of temporally adjacent time delay means are substantially equal.

2. An apparatus according to claim 1 wherein the minimum time delay means generates reflections of the electrical signal with a total delay time from the input of the electrical signal to a reflection within the time delay means of M times the delay time $T_1$ where M is a positive number greater than one, and the delay time $T_1$ substantially equals:

$$(1/M)\ \text{antilogarithm}_a\ (1/N\ \text{logarithm}_a\ M+\text{logarithm}_a\ T_N).$$

3. An apparatus according to claim 2 wherein the N−2 time delay means generate reflections of the electrical signal with total delay times to reflections within the time delay means of M times the delay time $T_X$, where X is a positive integer between 2 and N−1 inclusive, and the delay time $T_X$ for each time delay means substantially equals:

$$\text{antilogarithm}_a\ (\text{logarithm}_a\ T_1+((X-1)/N)\ \text{logarithm}_a\ M).$$

4. An apparatus according to claim 1 wherein the time delay means generates reflections of the electrical signal, and the logarithms of the total delay times to reflections from an output signal causing the reflections are substantially equally spaced.

5. An apparatus according to claim 1 wherein the N−2 time delay means generate reflections of the electrical signal with total delay times to reflections within the time delay means of M times the delay time $T_X$, where X is a positive integer between 2 and N−1 inclusive, and the delay time $T_X$ for each time delay means substantially equals:

$$\text{antilogarithm}_a\ (\text{logarithm}_a\ T_1+((X-1)/N)\ \text{logarithm}_a\ M).$$

6. An apparatus according to claim 1 wherein the minimum time delay means generates reflections of the electrical signal having a total delay time to a reflection within the time delay means of three times the delay time $T_1$, and the delay time $T_1$ substantially equals one third of antilogarithm$_a$ (1/N logarithm$_a$ 3+logarithm$_a$ $T_N$).

7. An apparatus according to claim 6 wherein the N−2 time delay means have a total delay time to a reflection within each time delay means of three times the delay time $T_X$, where X is a positive integer between 2 and N−1 inclusive, and the delay time for each time delay means substantially equal:

antilogarithm$_a$ (logarithm$_a$ $T_1$+((X−1)/N) logarithm$_a$ 3).

8. An apparatus according to claim 1 wherein the N−2 time delay means have a total delay time to a reflection within each time delay means of three times the delay time $T_X$, where X is a positive integer between 2 and N−1 inclusive, and the delay time for each time delay means substantially equals:

antilogarithm$_a$ (logarithm$_a$ $T_1$+((X−1)/N logarithm$_a$ 3).

9. An apparatus according to claim 1 wherein the minimum time delay means has a total delay time to a reflection within the time delay means of two times the delay time $T_1$, and the delay time $T_1$ substantially equals one half of antilogarithm$_a$ (1/N logarithm$_a$ 2+logarithm$_a$ $T_N$).

10. An apparatus according to claim 9 wherein the N−2 time delay means have a total delay time to a reflection within each time delay means of two times the delay time $T_X$, where X is a positive integer between 2 and N−1 inclusive, and the delay time for each time delay means substantially equals:

antilogarithm$_a$ (logarithm$_a$ $T_1$+((X−1)/N logarithm$_a$ 2).

11. An apparatus according to claim 1 wherein the N−2 time delay means have a total delay time to a reflection within each time delay means of two times the delay time $T_X$, where X is a positive integer between 2 and N−1 inclusive, and the delay time for each time delay means substantially equals:

antilogarithm$_a$ (logarithm$_a$ $T_1$+((X−1)/N logarithm$_a$ 2).

12. An apparatus according to claim 1, further comprising:

means for driving a plurality of amplifiers of a multiple channel amplifier system;

means for dividing the time delay means into a plurality of groups corresponding to the plurality of amplifiers; and means for connecting the groups of time delay means to the amplifiers wherein a different group of time delay means drives each amplifier.

13. An apparatus according to claim 1 wherein the time delay means generate reflections of the electrical signal, having reflections with total delay times to reflections from an input signal causing the reflections of $t_1, t_2, \ldots t_n$ for time delay means 1, 2, . . . N respectively, and the total delay time $t_x$ to a reflection substantially equals:

antilogarithm$_a$ (logarithm$_a$ $t_1$+((X−1)/N) logarithm$_a$ 3)

where N equals the number of time delay means having such reflections and the time between the temporally adjacent outputs after reflections begin substantially equals antilogarithm$_a$ (1/(N+n)) logarithm$_a$ 3.

14. An apparatus according to claim 1 further comprising means for summing the outputs of the time delay means.

15. An apparatus having N time delay means, N being at least two, for providing simulated reverberation of an electrical signal representative of sound, comprising in combination:

maximum time delay means for delaying the electrical signal; and minimum time delay means functionally in parallel with the maximum time delay means for delaying the electrical signal wherein at least one of the time delay means generates reflections of the electrical signal, and the differences between the logarithms of the time delays to temporally adjacent output signals are sustantially equal.

16. An apparatus according to claim 15 wherein the N time delay means generate reflections of the electrical signal, and the logarithms of the total delay times to reflections from an output signal causing the reflections are substantially equally spaced.

17. An apparatus according to claim 15 wherein the N time delay means generate reflections of the electrical signal with total delay times to reflections from an output signal causing the reflections of $t_1, t_2, \ldots t_n$ for time delay means 1, 2, . . . N respectively, and the total delay time $t_x$ to a reflection substantially equals:

ti antilogarithm$_a$ (logarithm$_a$ $t_1$+((X−1)/N) logarithm$_a$ 3)

where N equals the number of time delay means having such reflections and the time between the temporally adjacent outputs after reflections begin substantially equals antilogarithm$_a$ (1/N+n)) logarithm$_a$ 3.

18. An apparatus according to claim 15 further comprising means for summing the outputs of the time delay means.

* * * * *

UNITED STATES PATENT AND TRADEMARK OFFICE

CERTIFICATE OF CORRECTION

PATENT NO. : 4,350,845

DATED : September 21, 1982

INVENTOR(S) : William H. Hall; John R. Saul

It is certified that error appears in the above-identified patent and that said Letters Patent are hereby corrected as shown below:

In Column 6, line 32, "delay" should read---time delay---

In Column 9, line 8, "equal:" should read ---equals:---

In Column 10, line 46, "ti" should be deleted

In Column 10, line 52, "(1/N+n))" should read

---(1/(N+n))---

Signed and Sealed this

First Day of February 1983

[SEAL]

Attest:

GERALD J. MOSSINGHOFF

Attesting Officer

Commissioner of Patents and Trademarks